US007191960B1

(12) United States Patent
Schrock et al.

(10) Patent No.: US 7,191,960 B1
(45) Date of Patent: Mar. 20, 2007

(54) SHOWER HEAD

(76) Inventors: Ray V. Schrock, 1020 Hickory Hill Rd., Sapulpa, OK (US) 74066; Keith A. Holman, 2713 S. Elder Ave., Broken Arrow, OK (US) 74012; Jason L. Parrish, 921 W. Boston, Broken Arrow, OK (US) 74012

( * ) Notice: Subject to any disclaimer, the term of this patent is extended or adjusted under 35 U.S.C. 154(b) by 0 days.

(21) Appl. No.: 11/368,152

(22) Filed: Mar. 6, 2006

(51) Int. Cl.
*B05B 7/26* (2006.01)

(52) U.S. Cl. ..... 239/315; 239/316; 239/318; 239/305; 239/308; 222/145.5; 137/893

(58) Field of Classification Search ..... 239/305, 239/307, 308, 315, 316, 318; 222/145.5, 222/145.7, 630; 4/903, 605; 137/893
See application file for complete search history.

(56) References Cited

U.S. PATENT DOCUMENTS

| | | | | | |
|---|---|---|---|---|---|
| 2,058,901 | A | * | 10/1936 | McPherson | 422/266 |
| 3,003,703 | A | * | 10/1961 | Lambton | 239/309 |
| 3,091,402 | A | * | 5/1963 | Palmer | 239/315 |
| 3,713,585 | A | * | 1/1973 | Conklin | 239/307 |
| 4,881,575 | A | * | 11/1989 | Smith | 137/889 |
| 5,454,516 | A | | 10/1995 | Smyrl | |
| 5,562,248 | A | | 10/1996 | Khalifka | |

* cited by examiner

*Primary Examiner*—Dinh Q. Nguyen
(74) *Attorney, Agent, or Firm*—William S Dorman

(57) ABSTRACT

A shower head for dispensing a plurality of liquids into a continuous shower stream comprising a main shower head consisting of a divergently outwardly extending conical chamber bordered by a conical shell and a perforated arcuate member opposite from an apex of the conical chamber and through which water is sprayed onto the operator of the shower, a plurality of liquid dispensers arranged circumferentially around the main shower head, the main shower head having a main button moveable to an "off" position and an "on" position, each separate liquid dispensing member having its own chamber for containing a quantity of liquid therein to be dispensed into the main shower stream, passageways in each separate compartment communicating between the liquid contained in that compartment and the main shower head, a separate compartment button for each compartment and having an "on" and an "off" position, each compartment button in its "off" position preventing communication between the liquid in that compartment and the main shower head, each compartment button in the "on" position permitting communication between the liquid contained in that compartment and the main shower portion, whereby, when an operator commences taking a shower with the main button in the "on" position, he can selectively cause the introduction of liquid from any one of the liquid containing compartments by selectively moving the button for that compartment to the "on" position.

3 Claims, 4 Drawing Sheets

SHOWER HEAD

BACKGROUND OF THE INVENTION

1. Field of the Invention

The present invention relates to a liquid dispensing device and more particularly, to a shower head with selective liquid dispensers which may be adapted for selectively dispensing any one of a plurality of viscous liquids, such as soap and shampoo, available at the shower head, into the water stream of the shower head during the use thereof.

2. Prior Art

The use of dispensing devices is known in the prior art. More particularly, liquid dispensing devices have been provided heretofore and utilized for the purpose of dispensing liquid products during a shower activity.

SUMMARY OF THE INVENTION

The present invention involves a shower head having a main portion that provides a continuous stream of water through a conically shaped head and a perforated arcuate member. A plurality of liquid dispensers are arranged circumferentially around the main portion of the shower head. The main shower head is provided with a main button which, in its operative position, permits communication of the main shower stream with one or all of the liquid dispensers. Each liquid dispenser is provided with its own compartment button which, when pushed to the operative position will cause the dispensing of liquid soap, shampoo or conditioner; i.e., whatever liquid is in that particular compartment. Each compartment button may be provided with a separate timing mechanism, or quantity dispensing mechanism, so that, when the compartment button is pushed, a predetermined amount of the liquid soap, shampoo or conditioner will be dispensed into the main stream. The inner end of the main button shaft is provided with a venturi portion or venturi throat which, when the main button is in its operative position, will have three venturi openings lined up, respectively, with each of the three liquid dispensing mechanisms. When the main button is in its operative position, a stream of water from the water source will pass through the venturi portion and create a venturi effect in each of the three compartments, assuming that the individual buttons on those compartments are in the "on" position. When the button for a particular compartment is in the "on" position for that compartment, an angled hole through the shaft of that button will align venturi openings in the body associated with that compartment with the venturi openings leading to the main button. If the button for a particular compartment is moved to its "off" position, then the angled opening through the button shaft of that particular compartment will be offset to prevent the venturi effect from reaching that compartment.

A separate pouch is provided for each compartment and it communicates through the venturi openings and through the throat portion of that particular pouch to supply soap, shampoo or conditioner as the case may be.

DETAILED DESCRIPTION OF THE PREFERRED EMBODIMENTS

Figure 1:
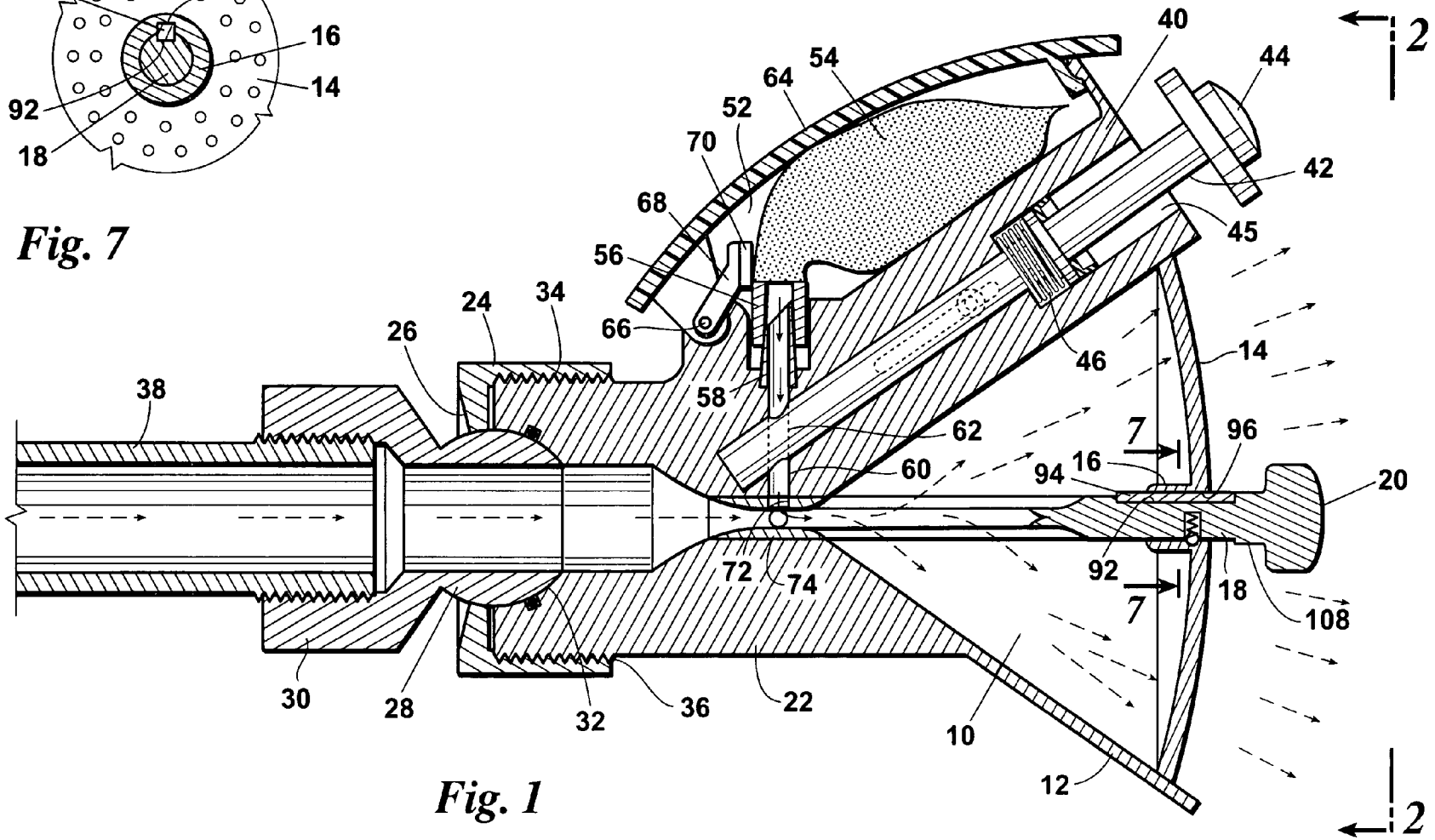
FIG. 1 is a longitudinal sectional view through a shower head constructed in accordance with the present invention and showing one of the pouches and associated structure for allowing liquid to be introduced into the shower stream.

Referring now to the drawings in detail, FIG. 1 is a cross-sectional view taken through the shower head of the present invention and showing one of three compartments whose effect is combined with that of the shower head itself. Thus, the shower head consists of a divergently outwardly extending conical chamber 10 bordered by a conical shell 12, and an arcuate member 14 closing off the chamber 10 and providing a bearing portion 16 to permit the inward and outward movement of a shaft 18, the end of which includes a "button" 20. The conical shell 12 connects with a rearwardly extending boss 22 which is also threadedly connected to a coupling 24. The coupling 24 is threadedly received on the left-hand end of the boss 22 and is provided with a flange 26 which surrounds a spherical end 28 of a fitting 30. The spherical portion 28 of the fitting 30 is received in a hemispherical recess 32 in the boss 22 and the flange 26 urges the spherical end 28 inwardly into the hemispherical recess 32 of the boss 22. The coupling 24 is provided with threads 34 which mate with threads 36 on the left-hand end of the boss 22. The fitting 30 is threadedly received on the end of a water pipe 38 which is provided for conventional shower stalls. In any event, when the members are connected in the manner shown in FIG. 1, the boss 22 can rotate around the hemispherical portion 28 of the fitting 30, if desired. Tightening the coupling 24 will hold the members in the desired position.

Figure 4:
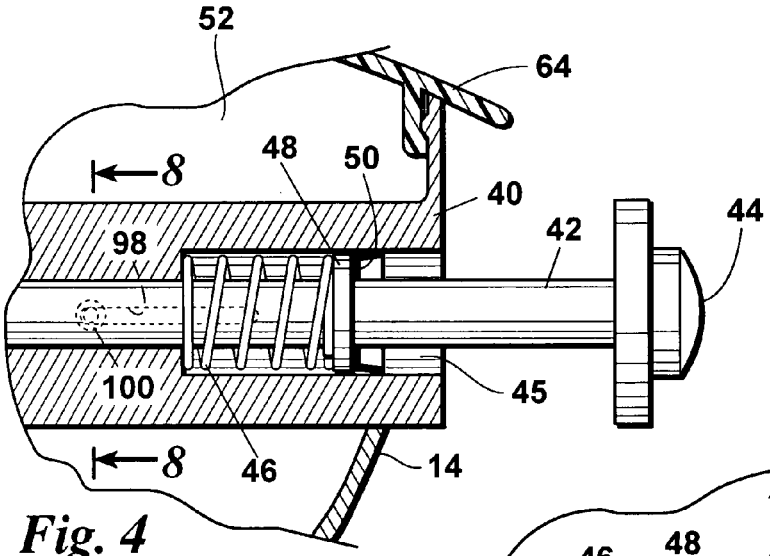
FIG. 4 is a sectional view through one end of the compartment "button" showing the same in an "open" (non-communicating) position and with the "timer" actuated.

The main compartment 10 of the shower head provides water (shown in dashed lines) from the center of the shaft 20 through holes (not shown) in the arcuate member 14. Above the boss 22 is shown a cylindrical member 40 which houses a shaft 42 provided with an external button 44 for operating a liquid dispenser such as a soap dispenser, as will hereinafter appear. The button 44 (and hence the shaft 42) is pushed into the operative position thereof by virtue of compression of the spring 46 in the leftmost portion of the bore 45. The shaft 42 has thereon a washer 48 which is held in position on the shaft 42 by means of an inverted cup washer 50 (see FIGS. 4 and 5). The inverted cup washer 50 has a friction fit with respect to the bore 45. The inverted cup washer 50 is flared outwardly (to the right) as will appear in FIGS. 4 and 5. The outward flaring of the cup washer 50 creates an increased friction with the bore 45 assuming that the operator has pushed the button 44 from the FIG. 4 position to FIG. 5 position. The spring 46 will immediately exert its influence on the washer 48 tending to move the shaft 42 towards the right. The inverted cup washer 50, however, because of its friction fit with the bore 45 will resist this movement for a period of time until the inclined bore 62 goes out of alignment with the venturi opening 60. By adjusting the friction fit of the cup washer 50, the time during which liquid material may be dispensed from the pouch 54 can be varied.

Figure 2:
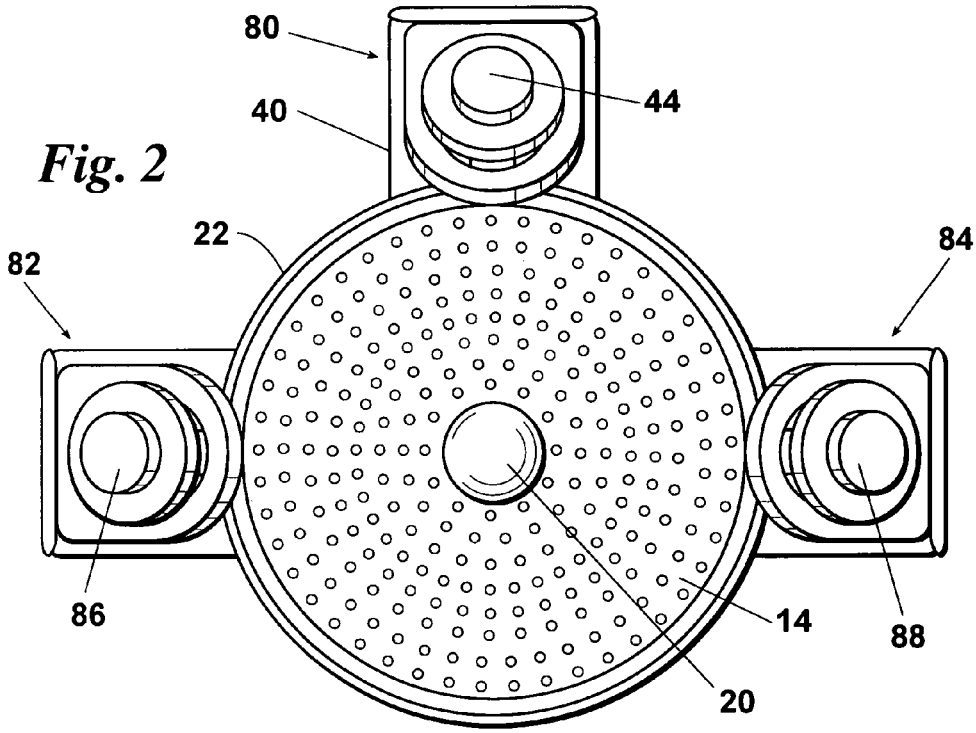
FIG. 2 is a right-hand side view of the shower head of FIG. 1 looking along viewing line 2—2 of FIG. 1, showing the shower head and its association with three separate liquid dispensing compartments.

The cylindrical portion 40 represents the main portion of the dispensing chamber 80 which cooperates with two additional dispensing chambers 82 and 84 (see now FIG. 2) which surround the main shower boss 22 in a circumferential array as shown.

Figures 6, 9:
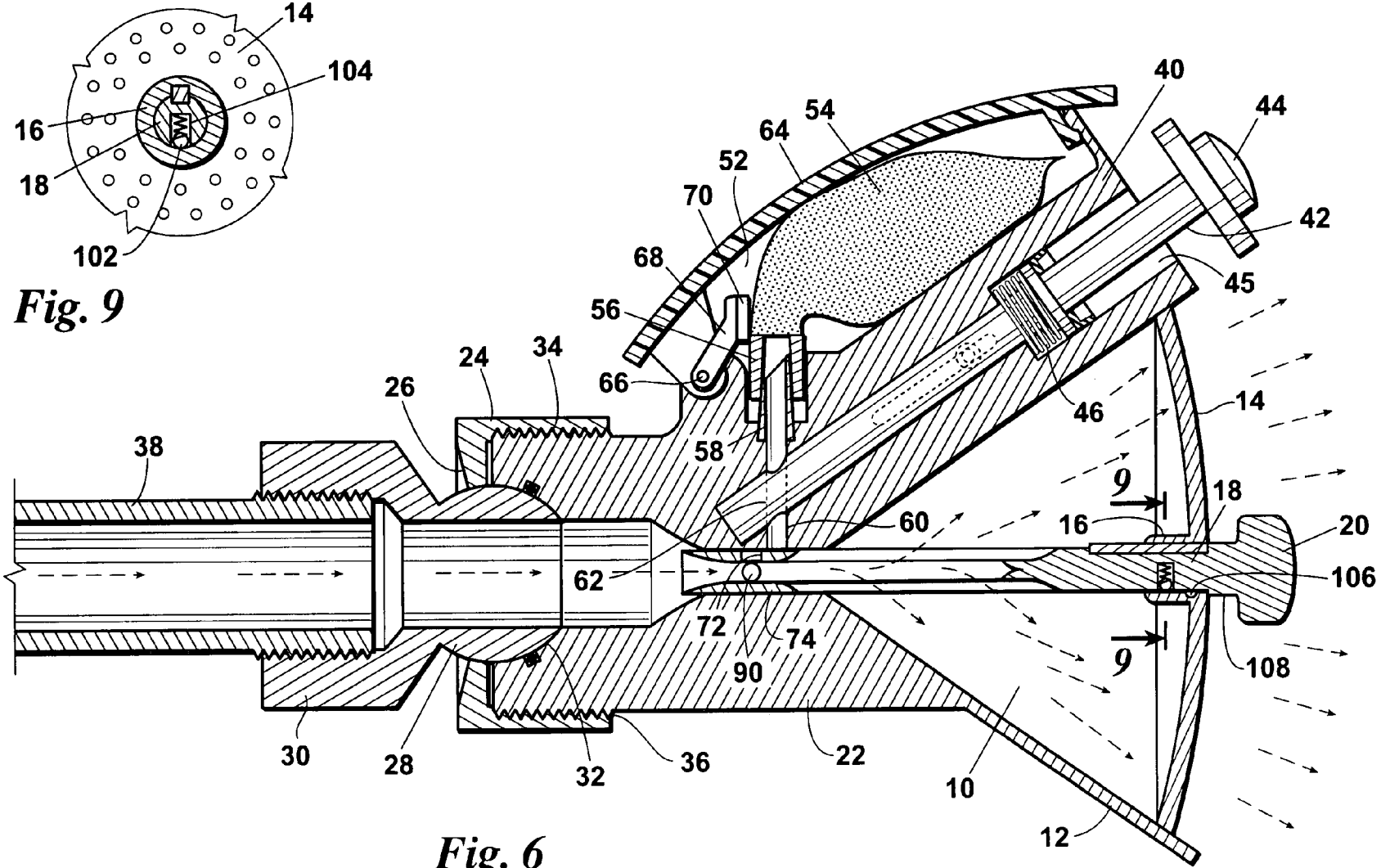
FIG. 6 is a view similar to FIG. 1 but showing the main shower head "button" in a closed position whereby none of the three dispensing compartments can be in communication with the shower head.
FIG. 9 is a cross-sectional view of the rotary locking means for the main button shaft looking along section line 9—9 of FIG. 6.

Compartment 80, for example, is designed to dispense soap, for example, into the main stream; compartment 82 is designed to dispense shampoo and compartment 84 can be used to dispense conditioner. Compartment 80 is shown having its compartment button 44 in the 12 o'clock position. Compartment 82 which is in the 9 o'clock position will have its compartment button 86 extending outwardly and associated with the compartment 82 in exactly the same way as button 44 is associated with compartment 80. The same consideration holds true for compartment 84 which shows its compartment button 88 associated in the same way as button 44 associated with compartment 80. The opening 90 in the venturi portion 74 of the shaft 18, as shown in FIG. 6 would be for the purpose of connecting the compartment 84 to the shower head 10.

Above the cylindrical portion 40 there is a chamber 52 which houses a flexible pouch 54, containing, in this instance, a quantity of liquid soap and connecting at its outer end with a hollow shaft 56. Actually, the shaft 56 can be the hollow outlet end of the pouch 54 and the same is received over a hollow needle portion 58 which, in turn, is connected to the upper portion of a venturi passageway 60. The venturi passageway 60 is in alignment with an inclined bore 62 through the lower end of the shaft 42.

The pouch 54 is held in the compartment 52 by virtue of a pivotal and arcuate cover 64 which pivotally connects to the left-hand end of the cylindrical member 40 by means of a pin 66. When the pouch is not in the compartment 52, the shaft or outlet portion 56 of the pouch 54 is removed from the needle 58 and a spring-urged finger 68, having a padded end 70 attached thereto, is adapted to be urged (by the spring mentioned above) into contact with the angled upper end of the needle 58. (See FIG. 3)

When the elements occupy the relative positions shown in FIG. 1, the interior of the pouch 54 is in communication with the conical chamber 10 through the outlet 56 of the pouch 54, the needle 58, the venturi passageway 60 and the inclined bore 62 of the shaft 42. When water passes through the pipe 38 towards the right and into the chamber 10, a venturi effect will be created in the venturi portion 74 and a reduced pressure will suck the material from the pouch 54 down through the various passageways just described.

The lower end of the venturi opening 60 aligns with an opening 72 on the inner venturi throat portion 74 of the shaft 18 (as best shown in FIG. 1). The venturi throat 74 slidably engages the boss 22 in the region of the apex of the cone 10. The inner configuration of the venturi throat mates with portions of the boss 22 above and below the venturi throat so as to provide a true venturi passageway through the center of the venturi throat 74. The venturi passageway 60 leading down from the individual dispensing chambers are in alignment with the venturi throat and communicate with passageways further the venturi throat such as passageway 27 for the compartment shown in FIG. 1. The shaft 18 for the main button 20 has a longitudinal axis which is collinear with the longitudinal axis of the cone 10.

However, if the main button 20 is moved inwardly to the position shown in FIG. 6, the various venturi openings 58, 60 and 62 will no longer be in alignment with the opening 72 and thus the venturi effect will be terminated. Actually, in the position shown in FIG. 6, the venturi effect will be terminated for all of the compartments 80, 82 and 84.

Figure 3:
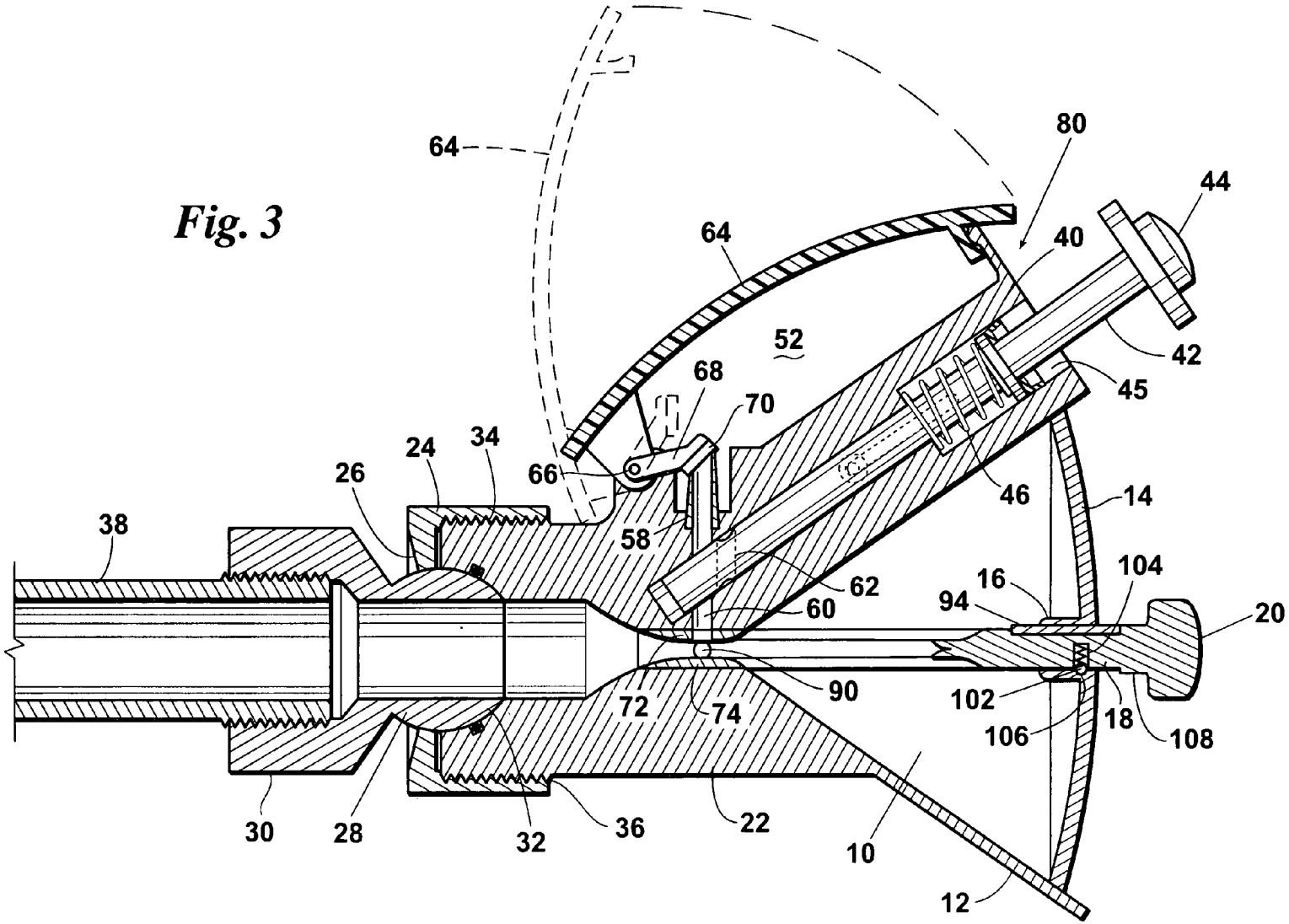
FIG. 3 is a view similar to FIG. 1 but showing the pouch removed from its compartment.

The termination of the venturi effect in a single compartment, such as 80, can be realized by moving the associated compartment shaft 42 outwardly (see FIG. 4) so that the inclined passageway 62 will be offset to the right from its operative position as shown in FIG. 3. FIG. 3 also shows the pouch removed. The compartment cover 64 can move outwardly as indicated, and the finger 68 with its pad 70 will cover the open end of the needle 58.

Its important for consideration of the present invention that the main button shaft 18 be held in a fixed rotary position, although it can be moved longitudinally from the position shown in FIG. 1 to that shown in FIG. 6. It is also important that the compartment shaft 42 be also rotationally locked so that the inclined bore 62 will properly mate with the venturi passageways 60 when the shaft 42 is in the position shown in FIGS. 1 and 6.

Figure 7:
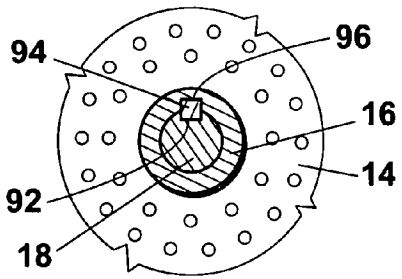
FIG. 7 is a cross-sectional view of the rotary locking means for the main button shaft looking along section line 7—7 of FIG. 1.

For the purpose of locking the main button shaft 18 in a fixed rotary position, FIG. 7 shows that the end portion of the main button shaft 18 passes through the bearing portion 16 of the arcuate member 14. The shaft 18 is provided with a key slot 92 in which is received an elongated key 94. When the key 94 is received in the key slot 92 it is also able to slide in a key way 96 provided on the inner peripheral of the bearing member 16.

Figure 8:
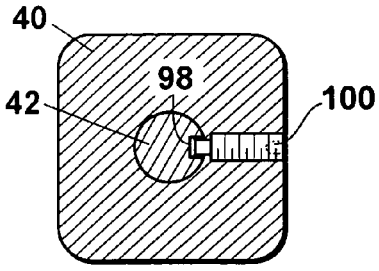
FIG. 8 is a cross-sectional view of the rotary locking means for the compartment button shaft locking along section line 8—8 of FIG. 4.

It is also important that each compartment button shaft, such as shaft 42, be prevented from rotating when placed in position so that the inclined bore 62 can be aligned with the venturi opening 60. In this regard, (see FIG. 8) the shaft 42 will be provided with a longitudinal slot 98 in which the end of a set screw 100 can be received.

When the operator of the shower head 10 moves the button 20, and hence the shaft 18, it is important that he knows when the venturi openings are in alignment with the venturi passageways. In this regard, a spring loaded ball 102 is mounted in a radial opening 104 in the shaft 18 (See FIGS. 1, 3, 6 and 9).

In FIG. 6, the button 20 is shown as pushed towards the left whereby the various venturi openings 72, etc., are out of alignment with the venturi passageways 60. The shoulder 108 on the exterior of the shaft 18 prevents the shaft 18 from being moved further to the left than shown in FIG. 6. However, when the operator pulls outwardly on the button 20 to move the shaft 18 towards the operative position shown in FIGS. 1 and 3, the ball 102 in the radial opening 104 will be urged outwardly by the spring therein until it reaches the recess 106 in the inner periphery of the flange 16, in which case, the operator will sense, as in the manner of a ball point pen, that the shaft is in the right position and the ball 102 will be lodged in the recess 106.

OPERATION

Figure 5:
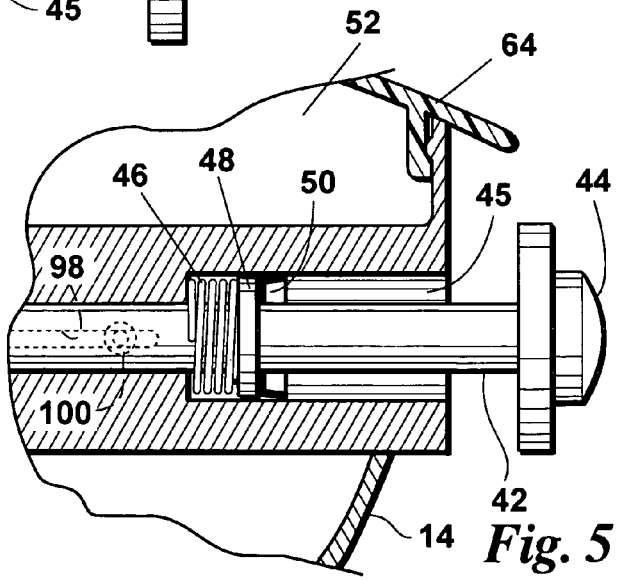
FIG. 5 is a view similar to FIG. 4 but showing the compartment "button" in a closed and operative position.

Assuming that a person is taking a shower and that the main "button" 20 is in the "on" position shown in FIG. 1, then the possibility of aligning up with all three compartments is present. However, assuming that the compartment button 44 (shown in FIG. 1) is actually in the "off" position shown in FIG. 3, communication between the main stream and the individual pouch 54 shown in FIG. 1 is not possible. The person (operator) taking the shower will first push the compartment button 44 inwardly so that various elements represent the positions shown in FIG. 1, in which case the inclined opening 62 is now in alignment with the opening 72 through the venturi portion 74. Thus, when liquid passes through the venturi portion 74 and into the chamber 10, a suction will be created at the opening 72 through the venturi passageway 60 through the inclined opening 62 through the shaft 42, through the needle valve 58 and through the opening 56 of the pouch 54. At this time liquid will continue to run through the passageways mentioned as long as the spring 46 remains compressed as shown in FIG. 5. However, as indicated previously, because of the timing mechanism, the button 44 will ultimately move outwardly to the position shown in FIG. 4, at which time the dispensing of liquid from the pouch 54 is discontinued.

What is claimed is:

1. A shower head for dispensing a plurality of liquids into a continuous shower stream comprising a main shower head consisting of a divergently outwardly extending conical chamber bordered by a conical shell and a perforated arcuate member opposite from an apex of the conical chamber and through which water is sprayed onto the operator of the shower, a plurality of liquid dispensers arranged circumferentially around the main shower head, the main shower head having a main button shaft moveable to an "off" position and an "on" position, each separate liquid dispensing member having its own chamber for containing a quantity of liquid therein to be dispensed into the main shower stream, passageways in each separate compartment communicating between the liquid contained in that compartment and the main shower head, a separate compartment button for each compartment and having an "on" and an "off" position, each compartment button in its "off" position preventing communication between the liquid in that compartment and the main shower head, each compartment button in the "on" position permitting communication between the liquid contained in that compartment and the main shower portion, wherein an inner portion of the main button shaft is provided with a venturi portion through which a main stream of liquid passes from a water supply to the conical head and wherein a venturi throat is provided with a plurality of venturi openings which communicate individually with the liquid dispensing compartments through venturi passageways, whereby, when an operator commences taking a shower with the main button in the "on" position, he can selectively cause the introduction of liquid from any one of the liquid containing compartments by selectively moving the button for that compartment to the "on" position.

2. A shower head as set forth in claim 1 wherein the main button shaft has a longitudinal axis which is collinear with the central axis of the conical chamber and wherein the venturi portion mates with a portion of the shower head located at the apex of the conical chamber.

3. A shower head as set forth in claim 1 wherein each separated dispensing member is provided with a removable pouch for containing the liquid to be dispensed from that dispenser, each pouch having a discharge opening surrounding a needle passageway located within the compartment, the needle passageway communicating with the venturi opening which, in turn, communicates with an angled passageway through the shaft of the compartment button when the compartment button is in the "on" position.

* * * * *